US008453425B2

(12) United States Patent
Perry et al.

(10) Patent No.: US 8,453,425 B2
(45) Date of Patent: Jun. 4, 2013

(54) SOOT REDUCTION BY COMBUSTOR CONDITIONING

(75) Inventors: Robert James Perry, Niskayuna, NY (US); Patrick Pastecki, Albany, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 1169 days.

(21) Appl. No.: 12/358,635

(22) Filed: Jan. 23, 2009

(65) Prior Publication Data

US 2010/0186387 A1 Jul. 29, 2010

(51) Int. Cl.
*F02B 43/00* (2006.01)

(52) U.S. Cl.
USPC ..... 60/39.5; 60/772; 60/272; 123/1 A; 208/15; 585/3

(58) Field of Classification Search
USPC ..... 60/772, 39.5, 272, 273; 123/1 A; 208/15; 585/3
See application file for complete search history.

(56) References Cited

U.S. PATENT DOCUMENTS

| | | | | |
|---|---|---|---|---|
| 2,606,605 | A | 8/1952 | Rucks | |
| 2,622,677 | A | 12/1952 | Caffier et al. | |
| 4,161,160 | A * | 7/1979 | Hicks et al. | 123/1 A |
| 5,334,308 | A | 8/1994 | Graiff et al. | |
| 5,469,706 | A * | 11/1995 | Hoya | 60/739 |
| 5,584,894 | A * | 12/1996 | Peter-Hoblyn et al. | 44/301 |
| 5,596,130 | A | 1/1997 | Wright et al. | |
| 5,621,154 | A * | 4/1997 | Wright et al. | 585/3 |
| 5,621,154 | B2 | 4/1997 | Wright et al. | |
| 5,681,798 | A * | 10/1997 | Farng et al. | 508/425 |
| 5,725,611 | A * | 3/1998 | Wright et al. | 44/375 |
| 5,743,922 | A * | 4/1998 | Peter-Hoblyn et al. | 44/301 |
| 5,953,906 | A * | 9/1999 | Gamel et al. | 60/274 |
| 6,532,726 | B2 | 3/2003 | Norster et al. | |
| 7,428,890 | B2 * | 9/2008 | Lay et al. | 123/198 A |
| 7,559,960 | B2 * | 7/2009 | Sato | 44/301 |
| 7,604,672 | B2 * | 10/2009 | Smith et al. | 44/408 |
| 2005/0274063 | A1 | 12/2005 | Forester et al. | |
| 2006/0141408 | A1 | 6/2006 | Schiffer et al. | |
| 2006/0281033 | A1 | 12/2006 | Reale et al. | |
| 2007/0101969 | A1 * | 5/2007 | Lay et al. | 123/304 |
| 2007/0137217 | A1 * | 6/2007 | Alexander | 60/793 |

OTHER PUBLICATIONS

Zamansky et al., Chemical Additives for Maximizing Fuel Reactivity, Phase I Report, Feb. 4, 2000 pp. 1-20, GE Energy and Environmental Research Corporation, Irvine, CA 92618.

Howard et al., Soot Control by Fuel Additives, pp. 263-27, 1980, Prog. Energy Combust. Sci. vol. 6, Great Britain.

Somasundaram et al., Suppression of soot in the combustion of residual furnace oil using organometallic additives, Jul. 1989, pp. 921-924, Fuel, vol. 68, Butterworth & Co. Ltd.

(Continued)

*Primary Examiner* — William H Rodriguez
(74) *Attorney, Agent, or Firm* — Bracewell & Giuliani LLP

(57) ABSTRACT

A method of affecting soot particulate size in an internal combustion engine exhaust by selectively providing a phosphorous based additive to the engine during combustion. Soot particulate size can be increased or decreased depending on the particular additive provided. Also disclosed in a conditioning effect experienced by using a phosphorous based additive for a period of time. A conditioned engine can also have its exhaust properties affected during the life of its conditioned state. Manipulating particle size during engine operation can employ an oligomeric phosphorous compound. Engine conditioning can employ a monomeric phosphorous containing compound, an oligomeric phosphorous containing compound, a polymeric phosphorous containing compound, or combinations thereof.

20 Claims, 2 Drawing Sheets

OTHER PUBLICATIONS

Corporan et al., Evaluation of soot particulate mitigation additives in a T63 engine, Fuel Processing Technology 85, 2004, pp. 727-742, www.elsevier.com/locate/fuproc.

Edwin Corporan, Reduction of Particulate Emissions in Turbine Engines Using the +100 Additive, ESTCP Cost and Performance Report, WP-0121, Jun. 2006, 33 pages, OH 45433-7103.

* cited by examiner

SOOT REDUCTION BY COMBUSTOR CONDITIONING

BACKGROUND

1. Field of Invention

The present disclosure relates generally to a method of changing the particle size of engine exhaust as well as treating a combustion engine. More specifically, the present disclosure relates to introducing an additive into the fuel thereby causing a reduction in particle size of the exhaust and/or conditioning a jet engine to provide an extended period of time during which exhaust particle size alteration continues to persist.

2. Description of Prior Art

Jet aircraft typically use a fuel comprising a mix of gasoline and kerosene. The fuel can contain additives, such, antioxidants, antistatic agents, corrosion inhibitors, anti-freezing agents, and lubricants. A jet fuel classification code has been developed to identify different jet fuels. Commercial aircraft generally use Jet A type fuel or Jet B type fuel. Jet A fuel is a kerosene based jet fuel wherein the majority of its constituents range between C8-C15. Jet B is a naptha based fuel, or wide cut, having a molecule range from C5-C15.

Although very similar to commercial jet fuel, the military classifies its aircraft fuel with a different classification. Military aircraft fuel falls under the JP classification, most military aviation jet fuel is one of JP-1, JP-4, JP-5, JP-6, JP-7, JP-8, or JPTS. The JP class of fuels contains many of the same additives as the commercial grade fuels.

A recent study indicated that approximately 26 billion gallons of jet fuel per year were consumed in the United States which was approximated to result in an annual emission of about 7.0 million pounds of solid particulate matter. Evaluation of soot particulate mitigation additive in a T63 engine, Edwin Corporan, Fuel Processing Technology, 85 (2004) 727-742. The particulate matter was stated as being directly emitted by aircraft engines, or formed as a by product of nitrogen oxides (also referred to as $NO_X$), volatile organic compounds, or sulfur oxides ($SO_X$). Identified as an environmental hazard, the soot particulate can also create an identifiable emission signature, which is an undesired situation for a military aircraft that may need to operate inconspicuously.

SUMMARY OF INVENTION

Disclosed herein is a method of affecting particulate matter size in the exhaust of an internal combustion engine by combusting a hydrocarbon fuel and a phosphorous based compound in the internal combustion engine. Also disclosed is a method of conditioning a jet engine to provide an extended period of time during which exhaust particle size alteration continues to persist. In an embodiment the internal combustion engine has a fuel intake, an oxygen intake, a combustion chamber, and an exhaust. In one embodiment, the method includes operating the engine with fuel having a phosphorous containing agent. The fuel and agent are delivered to the combustion chamber with the fuel flow and combusted therein to form an agent combustion product. Combusting the fuel and agent in the engine can affect engine exhaust particle size. The particle size can be decreased, or optionally increased. In an alternative embodiment, the method includes conditioning the engine by continuing the fuel flow having the agent for a first period of time so that the agent combustion product is disposed within the engine. After a conditioning time period has lapsed, the agent flow to the engine can be stopped while continuing engine operation. The engine operation is enhanced by agent combustion product residing within the engine. The method may further include metering the flow of phosphorus containing agent to the fuel flow to form a fuel composition having up to about 10% by weight percentage of phosphorous. The phosphorous containing agent may be a compound such as a phosphate, a phosphite, a phosphine, a phosphonate, a phosphane, a phosphine oxide, a phosphate sulfur analog, a phosphite sulfur analog, a phosphine sulfur analog, a phosphonate sulfur analog, a phosphane sulfur analog, a phosphine oxide sulfur analog, or combination(s) thereof. Optionally, the phosphorous containing agent may be a polyalkenylthiophosphonic acid, a polyalkenylthio-phosphonic ester, polyalkenylphosphonic acid, polyalkenylphosphonic ester, triethyhexyl phosphate, triphenyl phosphate, tris-butoxyethyl phosphate, tributoxyethylphosphate, triisopropylphosphate, tributylphosphite, tris(2-ethylhexyl)phosphate, dibutylphosphorous chloride, dibutyl butylphosphonate, tributylphosphate, derivatives thereof, and combinations thereof.

The fuel flow can be jet fuel, gasoline, kerosene, diesel an alcohol, or any hydrocarbon used for combustion in an engine. The jet fuel can be Jet A fuel, Jet B fuel, JP-1 fuel, JP-4 fuel, JP-5 fuel, JP-6 fuel, JP-7 fuel, JP-8 fuel, or JPTS fuel. The conditioning period can be up to about 10 minutes, 9 minutes, 8 minutes, 7 minutes, 6 minutes, 5 minutes, 4 minutes, 3 minutes, 2 minutes, or another period of time. The method may include restarting phosphorous containing agent flow to the fuel flow, so that the agent mixes with the fuel and combusts to recondition the engine. In an embodiment the method further includes stopping phosphorous containing agent flow to the fuel flow, operating the engine for a period of time, restarting phosphorous containing agent flow to the fuel flow to recondition the engine, and repeating the steps of stopping, operating, and restarting. The internal combustion engine can be a jet engine.

BRIEF DESCRIPTION OF DRAWINGS

Some of the features and benefits of the present invention having been stated, others will become apparent as the description proceeds when taken in conjunction with the accompanying drawings, in which.

Figure 1:
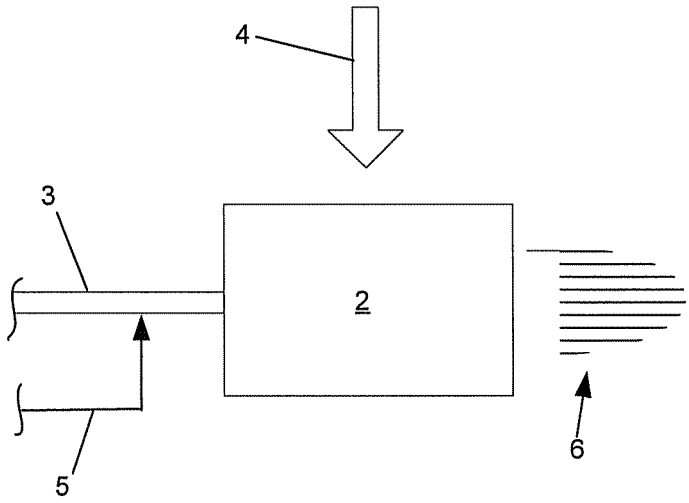
FIG. 1 is a schematic representing fuel and air flow to an engine and exhaust from the engine.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 1 is a schematic view of an internal combustion system that includes a combustion engine 2, and a fuel line 3 conveying fuel to the engine 2. Combustion air 4 is illustrated flowing to the engine 2 to allow for internal combustion with the fuel. Engine exhaust 6 is depicted exiting the engine 2. An additive injection 5 is illustrated connected to the fuel line 3 upstream of the engine 2. Optionally, the injection 5 can communicate directly to the engine 2, including into a combustion chamber (not shown) in the engine 2. As described herein, the additive injection provides an additive to the fuel before the fuel is combusted in the engine 2. Embodiments described herein include selectively injecting the additive to the fuel during engine 2 operation conditions the engine 2 so that engine operation is improved.

Engine 2 embodiments include any internal combustion engine, including gasoline engines used in personal and commercial vehicles, diesel engines, two stroke engines, four stroke engines, jet engines, jet turbine engines, turbo shaft engines, and, turbo prop engines to name a few. Examples of jet fuel include: Jet A fuel, Jet B fuel, JP-1 fuel, JP-4 fuel, JP-5 fuel, JP-6 fuel, JP-7 fuel, JP-8 fuel, or JPTS fuel. As described in further detail below, a control system may be included that meters additive flow to the engine 2 for combustion with the fuel. The control system is configurable to selectively meter additive flow to the fuel line 3. In one embodiment, the control system includes a selectively opened/closed valve installed inline with the additive injection 5 line.

It has been discovered that combusting a mixture of hydrocarbon fuel with a phosphorus based compound within an engine can affect soot particulate matter size in the engine's exhaust. It has also been discovered that an engine can be "conditioned" by combusting a phosphorus based compound within the engine for a period of time. In one example, the phosphorous based compound is included with combustion fuel and combusted in the engine. Selectively adding the phosphorus based compound for combustion can change the size of the particulate to a larger, or a smaller size from the baseline. Adding the phosphorus based compound to affect particle size can occur during any phase of the engine's operation, i.e. during idle, normal operating conditions, or maximum operating conditions. For the purposes of discussion herein, baseline conditions refer to conditions occurring or measured with no additive provided for combustion. Optionally, the phosphorus based compound can be combusted in the engine for a period of time, referred to herein as a conditioning period, for conditioning the engine. After the conditioning period, the phosphorus based compound addition can be stopped and continuing engine operation, such as by combusting fuel and combustion air. The conditioning may occur at any time during engine operation, this includes warm up, idling, and normal/minimum/maximum operating conditions. When the engine is for an aircraft, such as a jet engine, the conditioning may occur during all ground and/or flight operations.

One advantage realized by the engine conditioning using the phosphorus based compound is conditioned engines emit different sized particles in their exhaust than unconditioned engines. The different sizes can be larger or smaller than baseline sizes. Advantages of different sized particles that can be realized by combusting with the additive, or using a conditioned engine, include changing engine surface charge, pH, and the impact surface energy of the combustion engine. These advantages may produce the desired results of reduced emission agglomeration, reduced emission deposits, increased particle buoyancy, increased adhesion characteristics, a reduced infrared exhaust signature, and an increase in engine life.

Examples of conditioning periods include up to about 20 minutes, up to about 18 minutes, up to about 15 minutes, up to about 12 minutes, up to about 10 minutes, up to about 8 minutes, up to about 5 minutes, up to about 3 minutes, and can range between any of the aforementioned time periods. The conditioning period can vary depending on the engine, the fuel, and the particular phosphorus based compound added to the fuel. However, it is within the capabilities of those skilled in the art to determine a conditioning period or conditioning period range. A conditioning period may also be established by monitoring engine operating conditions, such as rpm, fuel consumption, power output, or exhaust properties.

The engine can be reconditioned after a period of operation. Reconditioning can be based on engine operation time or by monitoring engine performance and/or exhaust properties. For example, while a conditioned engine is operating, the exhaust can be monitored and when/if the exhaust conditions revert to an unconditioned state, the engine can be reconditioned by re-injecting the phosphorus based compound to the fuel. The steps of conditioning, stopping injection flow, and reconditioning can be repeated.

Examples of a phosphorus additive or phosphorus based additive include: a phosphate, a phosphite, a phosphine, a phosphonate, a phosphane, a phosphine oxide, a phosphate sulfur analog, a phosphite sulfur analog, a phosphine sulfur analog, a phosphonate sulfur analog, a phosphane sulfur analog, a phosphine oxide sulfur analog, and combinations thereof. Additional examples include: a polyalkenylthiophosphonic acid, a polyalkenylthiophosphonic ester, a polyalkenylphosphonic acid, a polyalkenylphosphonic ester, a triethyhexyl phosphate, a triphenyl phosphate, a tris-butoxyethyl phosphate, a tributoxyethylphosphate, a triisopropylphosphate, a tributylphosphite, a tris(2-ethylhexyl)phosphate, a dibutylphosphorous chloride, a dibutyl butylphosphonate, a tributylphosphate, derivatives thereof, and combinations thereof.

Phosphorus containing compounds for use in the phosphorus additive can include molecules having the form:

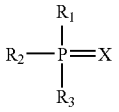

where X can be nil, O, S, or mixtures thereof. R1, R2, R3 may be same or different. Optionally R1, R2, R3=H, alkyl or alkenyl (C1-C200); aryl (C6-C10); heteroaryl (C4-C9); heteroalkyl (C2-C20); or O—R where R=alkyl or alkenyl (C1-C200); aryl (C6-C10); heteroaryl (C4-C9) or heteroallcyl (C2-C20). R1 may also be a halogen. A phosphorous containing compound suitable for one or more of the methods described herein may include or be formed by a series of repeating molecular and/or elemental units. Examples of molecules having repeating molecular and/or elemental units include monomeric compounds, oligomeric compounds and polymeric compounds. A method described herein may be performed using one or more of a monomeric compound, an oligomeric compound, or a polymeric compound; whereas another method may specifically require or exclude a monomeric compound, an oligomeric compound, or a polymeric compound. For example, affecting soot particulate matter size may employ only a monomeric phosphorous containing compound and/or an oligomeric phosphorous containing compound. Additionally, conditioning an engine as described above can involve injecting one or more of a monomeric phosphorous containing compound, an oligomeric phosphorous containing compound or a polymeric phosphorous containing compound, as well as a mixtures thereof.

Examples of an amount of additive provided, including the aforementioned compounds, include values up to about 10% by weight of the fuel flow. In another embodiment, the additive is provided in an amount from about 0.1% by weight of the fuel flow up to about 10% by weight of the fuel flow. In yet another embodiment, the additive is provided in amounts ranging from about 0.1% by weight of the fuel flow up to about 10% by weight of the fuel flow, including increments therebetween of 0.1% by weight of the fuel flow.

Example 1

Figure 2:
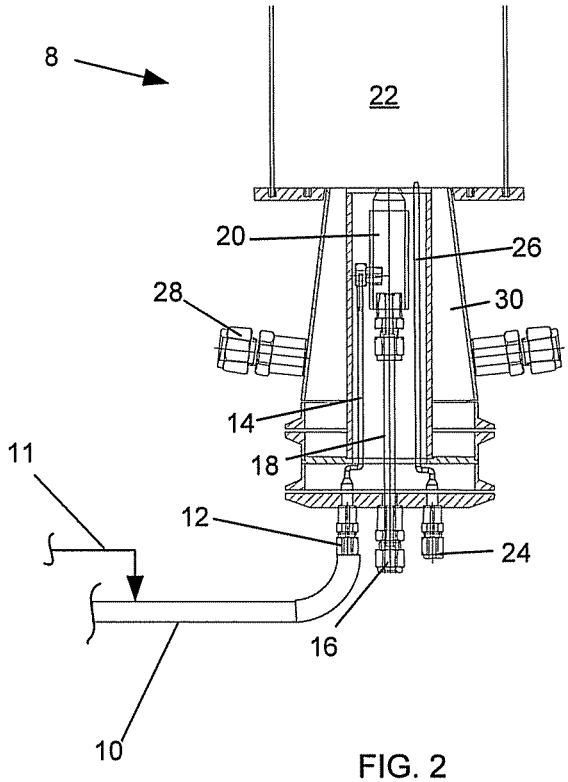
FIG. 2 is a schematic partial sectional view of an atmospheric combustor.

In one non-limiting example of use, an atmospheric combustor 8 (FIG. 2) was operated by supplying liquid fuel to the combustor 8 through fuel feed line 10. An additive was provided to the fuel feed line 10 through an additive injection 11, the mixture of fuel and additive exited the feed line 10 through a fuel nozzle 12 on the combustor 8. A lead line 14 downstream of the nozzle 12 carried the fuel/additive mixture to a mixing chamber 20. Atomizing air was delivered to the combustor 8 through an atomization air nozzle 16 and atomization air line 18 that terminated at the mixing chamber 20. The mixing chamber 20 included an exit on its upper end that communicated with a combustion chamber 22. Pilot gas was introduced through a pilot flame nozzle 24 that connected to a pilot flame line 26 that exited into the combustion chamber 22. Combustion air was provided through a combustion air nozzle 28 that communicated with a plenum 30 that surrounded the flow lines and mixing chamber 20. The fuel was delivered via a Teledyne Isco D-series syringe pump at 2 cc/min, atomizing air at 5 SLPM, combustion air at 40 SLPM, and pilot gas (CH4) at 2 SLPM.

Table 1 below list the additives, their respective weight percent, the measured particular matter (PM) concentration during conditioning, measured PM concentration after conditioning, the change in mean particle size during conditioning, and the change in mean particle size after conditioning. PM concentration was measured using a TSI Incorporated mode 3090 Engine Exhaust Particle Sizer with a rotating disc thermo diluter (TSI 379020) that was used to collect particle size and distribution data. The Change in PM concentration in Table 1 is a ratio of the measured PM while combusting fuel with additive over the measured PM while combusting fuel without additive (the baseline). The Change in Baseline in Table 1 compares the measured PM from combusting fuel without additive in an unconditioned combustor to the measured PM from combusting fuel without additive in a conditioned combustor. For example, when adding 3% by weight of 8Q462, the measured PM concentration was 10.39 times the baseline concentration and the measured PM after conditioning the combustor was 68% of the measured baseline PM. The presence of 3 wt % triphenyl phosphate in the fuel resulted in a fifty-fold increase in PM concentration during conditioning and twice as much after conditioning. During conditioning the mean particle size decreased to 14% of the original baseline value. When the additive was removed, the conditioned combustor showed little change from the baseline value.

TABLE 1

| | Wt % | Change in PM concentration | | Change in mean particle size | |
|---|---|---|---|---|---|
| Additive | Added | Conditioning | Conditioned | Conditioning | Conditioned |
| Tris(2-ethylhexyl)phosphate | 2.5 | 13.86 | 2.16 | 0.22 | 0.97 |
| Triphenyl phosphite | 3 | 50.86 | 2.11 | 0.14 | 1.03 |
| Tris-Butoxyethyl phosphate | 3 | 20.37 | 1.60 | 0.13 | 0.96 |

Example 2

In another non-limiting example, a Jet Cat™ type lab scale mini turbine (not shown) was operated and provided with fuel having a conditioning additive. More specifically, Jet A fuel (+additive) was delivered at about 65-70 mL/min to the turbine. A ½ inch Hastalloy X smoke meter probe was located about 6 inches beyond the engine exhaust outlet dump plane to obtain sample at a rate of about 3.5 to about 5.0 SLPM, with a primary dilution of 400, a secondary dilution of 620, the raw exhaust dilution factor was about 273, and an evaporation tube at 120° C. Example mini turbine operating conditions are provided in Table 2. Table 3 lists additives to the fuel and their respective weight percent, respective PM increase during conditioning, respective PM increase after conditioning, respective PM change in mean particle size during conditioning, and respective change in mean particle size after conditioning. 8Q462 is a commercially available product from GE Betz sold as Spec-Aid 8Q462 and is 17 wt % active. 8Q499 contains the same active agent as 8Q462 but is 60 wt % active and does not contain the metal chelator and antioxidant found in 8Q462.

TABLE 2

| | |
|---|---|
| Type | P60 |
| Idle Rpm (1/min) | 50000 |
| Max Rpm (1/min) | 165000 |
| Idle thrust (N) | 1 |
| max thrust (N) | 60 |
| EGT (° C.) | 480-730 |
| pressure ratio | 2 |
| massflow (kg/s) | 0.16 |
| Exhaust gas velocity (km/h) | 1350 |
| Power output (thrust) (kW) | 11.3 |
| Fuel consumption @ maxRpm (ml/min) | 185 |
| Fuel consumption @ idle (ml/min) | 70 |
| Fuel consumption @ idle (kg/min) | 0.055 |
| Fuel consumption @ maxRpm (kg/min) | 0.146 |
| specific fuel consumption @ maxRpm (kg/Nh) | 0.146 |
| weight (g) | 830 |
| diameter (mm) | 83 |
| lenght (incl. Starter) (mm) | 245 |

Example 3

In another non-limiting example, a CT7 T700 turboshaft engine (not shown) was operated and provided a conditioning operation. Example CT7 T700 specifications are: length 47 inches (T700-GE-700/701 series) to 48.2 inches (T700/T6A), diameter: 25 inches/26 inches (T700/T6E), dry weight: 437 pounds (T700-GE-700) to 537 pounds (T700/T6E), power output: 1,622 SHP (T700-GE-700) to 2,380 SHP (T700/T6E), compression ratio: 17x, specific fuel consumption: 0.433 (T700/T6E) to 0.465 (T700-GE-701A), power-to-weight ratio: 3.71 SHP/pound (T700-GE-700) to 4.48 SHP/pound (T700/T6E). Jet A (+additive) was delivered to the engine from 0.45 to 2.00 gallons per minute. A ½" Hastalloy X smokemeter probe was located 2" beyond dump plane of engine exhaust outlet to obtain a 3.5 to 5.0 SLPM sample flow rate. Primary dilution was 480, secondary dilution was 650, an evaporation tube was at 120° C. and a dilution factor from raw exhaust was about 230. The CT7 operating results are tabulated in Table 4 that lists additives to the fuel and their respective weight percent, respective PM increase during conditioning, respective PM increase after conditioning, respective PM change in mean particle size during conditioning, and respective change in mean particle size after conditioning.

TABLE 3

| | Wt % | Change in PM concentration | | Change in mean particle size | |
|---|---|---|---|---|---|
| Additive | Added | Conditioning | Conditioned | Conditioning | Conditioned |
| 8Q462 | 3 | 2.42 | 1.33 | 0.81 | 1.05 |
| 8Q499 | 0.85 | 2.64 | 1.87 | 0.89 | 1.16 |
| Tributoxyethylphosphate | 3 | 4.34 | 1.43 | 1.06 | 1.25 |
| Triisopropylphosphate | 3 | 5.56 | 2.62 | 1.20 | 1.07 |
| Tributylphosphite | 3 | 6.14 | 3.10 | 1.21 | 1.12 |
| Tris(2-ethylhexyl)phosphate | 3 | 8.38 | 3.23 | 1.39 | 1.08 |
| Dibutylphosphorous chloride | 3 | 39.12 | 3.16 | 1.65 | 1.19 |
| Dibutyl butylphosphonate | 3 | 40.73 | 8.27 | 1.79 | 1.26 |
| Tributylphosphate | 3 | 76.30 | 2.69 | 1.81 | 1.33 |

TABLE 4

| | Engine | Wt % | Change in PM concentration | | Change in mean particle size | |
|---|---|---|---|---|---|---|
| Additive | Condition | Added | Conditioning | Conditioned | Conditioning | Conditioned |
| 8Q462 | Ground Idle | 3 | 1.83 | 1.14 | 0.93 | 0.99 |
| 8Q462 | Flight Idle | 3 | 1.28 | 1.00 | 0.97 | 1.00 |
| Tris(2-ethylhexyl)phosphate | Ground Idle | 1.5 | 5.14 | 1.23 | 0.74 | 0.93 |
| Tris(2-ethylhexyl)phosphate | Flight Idle | 1.5 | 3.06 | 1.05 | 0.65 | 0.98 |
| Tris(2-ethylhexyl)phosphate | Ground Idle | 3 | 38.19 | 1.09 | 0.43 | 0.90 |
| Tris(2-ethylhexyl)phosphate | Flight Idle | 3 | 26.53 | 1.04 | 0.33 | 0.95 |

Based on the results listed above, it is clear that phosphorous containing additives have an influence on the size and concentration of the particles formed in exhaust. It is also apparent that different combustion platforms are affected differently by the additives of this invention. An internal combustion engine conditioned as described herein can have an improved performance over an unconditioned engine. For example, a conditioned engine can form smaller sized particles in its exhaust; as listed above smaller particle sized emission may provide advantages.

Analysis of PM residue on glass filter paper indicated that a distilled water slurry of the PM collected had a pH=2 when 3% tris(2-ethylhexyl)phosphate was used as the additive. In addition, ion chromatographic analysis of the PM collected from both 3% tris(2-ethylhexyl)phosphate and 3% 8Q462 showed a significant amount of phosphate present in the particulate. In one example, the following values for phosphate were measured (phosphate μg/g), blank (control)<3.4, 8Q462=1000+/−10, Tris(2-ethylhexyl)phosphate=22,000+/−100. A Dionex model DX500 ion chromatograph, fitted with an AS18 column, 25 μL injection loop, and a membrane suppressor was used for the analysis of all anions. The eluent was potassium hydroxide in 18 MΩ water, at a flow rate of 1.0 mL/min and the elution mode was isocratic at 22 mM KOH from 0 to 7 minutes, gradient from 22 mM to 40 mM KOH from 7 to 8 minutes, and then isocratic from 8 to 16 minutes at 40 mM KOH. Detection was by suppressed conductivity. The analyte concentrations were calculated by comparison with a series of known standards.

Example 4

A residual or conditioning effect was observed with contact angle measurements on stainless steel (SS). SS had a water contact angle of 62.6°; when treated with Jet A and wiped clean the contact angle was 66.3°. Treatment with 8Q462 and subsequent wiping gave a contact angle of 77.2°. When SS coupons were treated with Jet A and 8Q462 and heated to simulate a heated combustion environment, the Jet A showed only a 70.4° contact angle as opposed to a 107.1° angle for the phosphorous containing additive. Comparison of the surface energies of the heated coupons showed that the bare SS coupon has relatively even contributions from both polar and dispersive forces. Treating with Jet A lowered the polar force by a factor of 2 while not affecting the dispersive force. The 8Q462 additive showed an order of magnitude decrease in the polar force of the surface and an increase in the dispersive force (Table 5) suggesting the hydrocarbon tail remains partially intact thereby influencing the metal surface. Further confirmation of the 8Q462 residue came from XRF analysis of the SS surfaces. A scan for P, S and C revealed that essentially no P, S or C was found on the clean SS sample or on the Jet A treated coupon. But significant residue attributed to 8Q462 was observed on the additive treated model.

TABLE 5

| Sample | Dispersive Force | Polar Force | Total (dyne/cm) |
|---|---|---|---|
| SS | 26.14 | 21.27 | 47.41 |
| SS/Jet A | 26.03 | 10.32 | 36.35 |
| SS/8Q462 | 32.81 | 1.43 | 34.24 |

Example 5

Support for the conditioning effect was obtained by treating a SS coupon with a 3% 8Q462 solution in Jet A, heating to 300° C. for 30 sec to simulate deposition on the nozzle, then subsequently treating the coupon 4 times with hot Jet A fuel and then twice with hexanes. As before, treatment with 8Q462 resulted in a large increase in the water contact angle indicating a hydrophobic surface was present. The first three washes with Jet A, which simulated changing from an additive laden fuel to the base fuel, showed little drop in contact angle until the fourth washing. This mirrored the results seen in the lab scale combustor where lower soot levels were seen for the pure Jet A fuel immediately after 8Q462 had been tested until residual surfactant had been removed and higher levels of soot, representative of Jet A were seen.

Figure 3:
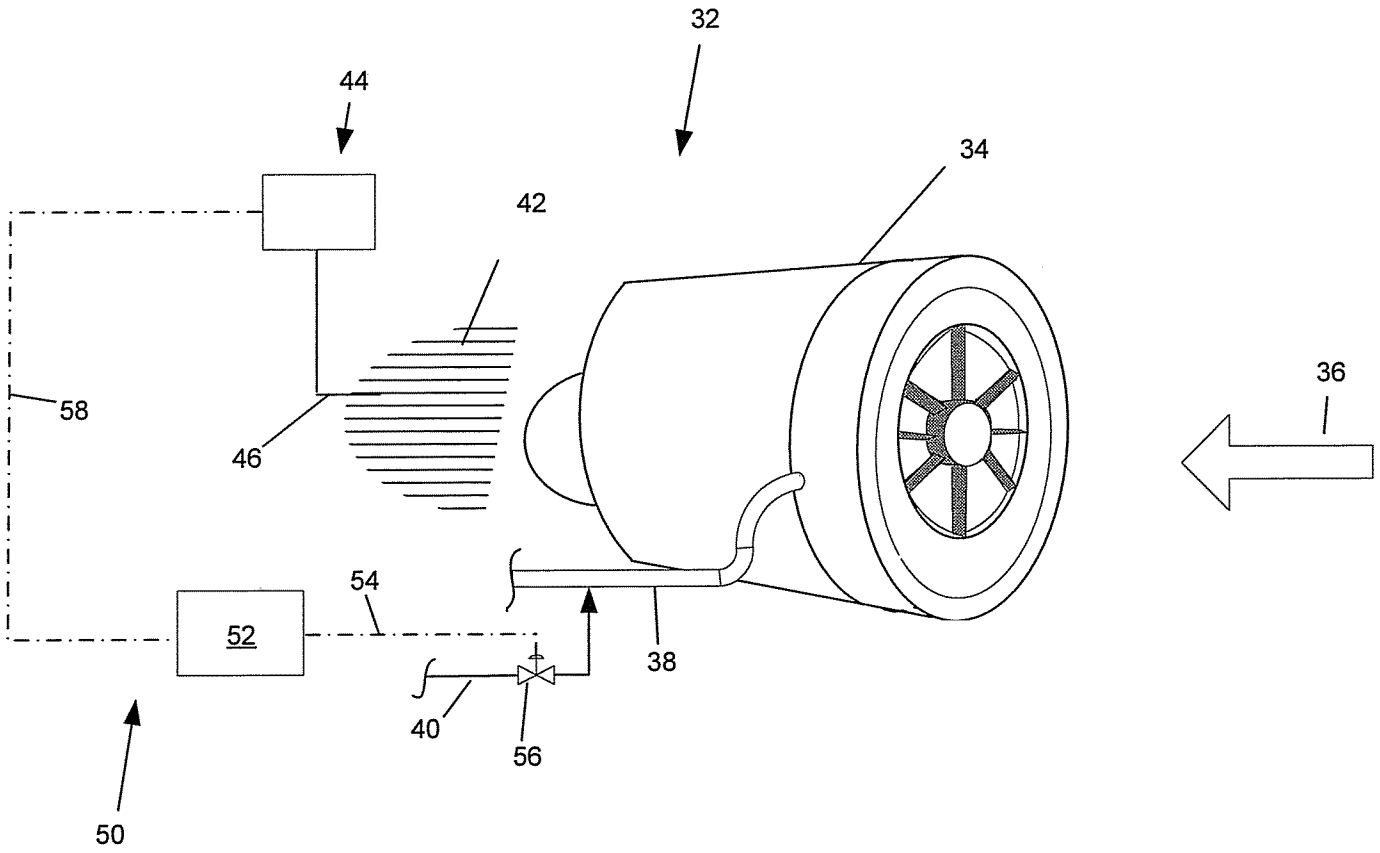
FIG. 3 is a side perspective view of a test engine having a test probe in the exhaust.

FIG. 3 is a perspective schematic view of a combustion system 2 having a turbine engine 34 receiving an air supply 36, a connected fuel feed line 38, an additive injection 40 connected to the feed line 38, an exhaust analyzer 44, and a control system 50. The control system 50 includes a control valve 56 provided in the additive injection 40 line and a controller 52 in communication with the control valve 56 via link 54 and in communication with the analyzer 44 via link 58. The analyzer 44 includes a sample probe 46 shown inserted into a flow of exhaust 42 exiting the turbine engine. The controller 52 can include a processor, such as an information handling system, having readable medium thereon with stored control commands. Optionally, the controller 52 can receive control commands externally. In response to the control commands received or generated by the controller 52, the controller 52 can adjust the control valve 56 opening. Control valve 56 adjustment includes full open, full closed, or an intermediate position.

In an embodiment, control commands direct the control valve to open for a conditioning period (to provide additive flow to the fuel for conditioning the engine), close at the end of the period (to cease additive flow to the fuel). Optionally, the control command can direct the valve to reopen at a pre-established time span for reconditioning the engine 34. In yet another alternative, control commands are generated in response to particulate readings taken by the sensor 44. The control commands can be generated by the controller 52, or externally and communicated with the controller 52. Examples of control commands generated in response to sensor 44 output include a command to open the valve 56 to initiate conditioning or reconditioning, close the valve 56 to end conditioning, or set the valve 56 at some percent open to regulate additive flow to the fuel line 38. Examples of sensor 44 output include PM concentration, PM dimensions, exhaust 42 properties or conditions, such as density, viscosity, composition, temperature, pressure, or flow. Alternatively, addition injection flow can be manually regulated without a controller 52.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of manipulating the exhaust of an internal combustion engine, the method comprising:

providing fuel flow to the engine for combustion in the engine; and selectively adding an additive to the fuel in an amount that ranges from about 1.5 percent by weight of the fuel to about 10 percent by weight of the fuel and that comprises at least one of polyalkenylthiophosphonic ester, polyalkenylphosphonic acid, and polyalkenylphosphonic ester, so that the additive is with the fuel during combustion to affect soot particulate matter size in the engine's exhaust.

2. The method of claim 1, wherein the fuel flow comprises a jet fuel selected from the list consisting of Jet A fuel, Jet B fuel, JP-1 fuel, JP-4 fuel, JP-5 fuel, JP-6 fuel, JP-7 fuel, JP-8 fuel, or JPTS fuel.

3. The method of claim 1, wherein the soot particulate size in the exhaust increases from a baseline amount with the additive addition.

4. The method of claim 1, wherein the soot particulate size in the exhaust decreases from a baseline amount with the additive addition.

5. The method of claim 1, wherein the soot particulate size in the exhaust returns to a baseline amount after stopping additive to the engine.

6. The method of claim 1, wherein the engine is a jet engine.

7. A method of conditioning an internal combustion engine having a fuel intake, an oxygen intake, a combustion chamber, and an exhaust, the method comprising:

operating the engine, so that fuel and oxygen flow from respectively from the fuel intake and oxygen intake to the combustion chamber where the fuel and oxygen are combusted;

delivering a phosphorous containing agent to the combustion chamber with the fuel flow and combusted therein to form an agent combustion product;

conditioning the engine by continuing agent delivery for a first period of time so that the agent combustion product is disposed within the engine;

stopping agent flow upon expiration of the first period of time; and continuing engine operation, so that continuing engine operation is enhanced by agent combustion product residing within the engine.

8. The method of claim 7, further comprising metering the flow of phosphorus containing agent to the fuel flow to form a fuel composition having up to about 10% by weight percentage of phosphorous.

9. The method of claim 7, wherein the phosphorous containing agent comprises a compound selected from the list consisting of a phosphate, a phosphite, a phosphine, a phosphonate, a phosphane, a phosphine oxide, a phosphate sulfur analog, a phosphate sulfur analog, a phosphine sulfur analog, a phosphonate sulfur analog, a phosphane sulfur analog, a phosphine oxide sulfur analog, a polyalkenylthio-phosphonic acid, polyalkenylthiophosphonic ester, polyalkenylphosphonic acid, polyalkenylphosphonic ester, triethyhexyl phosphate, triphenyl phosphate, tris-butoxyethyl phosphate, tributoxyethylphosphate, triisopropylphosphate, tributylphosphite, tris(2-ethylhexyl)phosphate, dibutylphosphorous chloride, dibutyl butylphosphonate, tributylphosphate, derivatives thereof, and combinations thereof.

10. The method of claim 7, wherein the phosphorous containing agent is provided to the fuel flow at a rate selected from the list consisting of up to about 10% by weight of the fuel flow.

11. The method of claim 7, wherein the fuel flow comprises a jet fuel selected from the list consisting of Jet A fuel, Jet B fuel, JP-1 fuel, JP-4 fuel, JP-5 fuel, JP-6 fuel, JP-7 fuel, JP-8 fuel, or JPTS fuel.

12. The method of claim 7 wherein the first period of time is up to about 10 minutes.

13. The method of claim 7, further comprising restarting phosphorous containing agent flow to the fuel flow, so that the agent mixes with the fuel and combusts to recondition the engine.

14. The method of claim 13, further comprising:

(a) stopping phosphorous containing agent flow to the fuel flow;

(b) operating the engine for a period of time;

(c) restarting phosphorous containing agent flow to the fuel flow to recondition the engine; and (d) repeating steps (a)-(c).

15. The method of claim 13, further comprising repeating step (c).

16. The method of claim 7, wherein the internal combustion engine is a jet engine.

17. The method of claim 7, further comprising restarting phosphorous containing agent flow to the fuel flow, so that the agent mixes with the fuel and combusts to recondition the engine.

18. A method of operating an internal combustion engine comprising:

a. combusting engine fuel and oxygen in a combustion chamber in the engine;

b. providing a combustion agent comprising up to about 10% by weight percentage of phosphorous;

c. conditioning the engine by delivering the combustion agent to the combustion chamber for a period of time, and combusting the combustion agent with the fuel and oxygen during the period of time; and d. continuing combusting engine fuel and oxygen in a combustion chamber in the engine after an expiration of the period of time.

19. The method of claim 18, wherein the combustion agent comprises a compound selected from the list consisting of a phosphate, a phosphite, a phosphine, a phosphonate, a phosphane, a phosphine oxide, a phosphate sulfur analog, a phosphate sulfur analog, a phosphine sulfur analog, a phosphonate sulfur analog, a phosphane sulfur analog, a phosphine oxide sulfur analog, a polyalkenylthio-phosphonic acid, polyalkenylthiophosphonic ester, polyalkenylphosphonic acid, polyalkenylphosphonic ester, triethyhexyl phosphate, triphenyl phosphate, tris-butoxyethyl phosphate, tributoxyethylphosphate, triisopropylphosphate, tributylphosphite, tris(2-ethylhexyl)phosphate, dibutylphosphorous chloride, dibutyl butylphosphonate, tributylphosphate, derivatives thereof, and combinations thereof.

20. The method of claim 18, wherein the period of time is up to about 10 minutes.

* * * * *